US008021810B2

(12) United States Patent
Takimoto et al.

(10) Patent No.: US 8,021,810 B2
(45) Date of Patent: Sep. 20, 2011

(54) IMAGE CARRIER, PROCESS CARTRIDGE AND IMAGE-FORMING APPARATUS

(75) Inventors: Hitoshi Takimoto, Minamiashigara (JP); Kenta Ide, Minamiashigara (JP); Toru Asahi, Minamiashigara (JP); Hidemi Nukada, Minamiashigara (JP); Takahiro Suzuki, Minamiashigara (JP); Koji Bando, Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 849 days.

(21) Appl. No.: 11/976,295

(22) Filed: Oct. 23, 2007

(65) Prior Publication Data

US 2008/0187846 A1 Aug. 7, 2008

(30) Foreign Application Priority Data

Feb. 2, 2007 (JP) ..... 2007-024610

(51) Int. Cl.
*G03G 15/00* (2006.01)

(52) U.S. Cl. ..... 430/57.1; 430/58.35; 430/60; 430/64; 430/66

(58) Field of Classification Search ..... 430/57.1, 430/58.35, 60, 64, 66
See application file for complete search history.

(56) References Cited

U.S. PATENT DOCUMENTS

| | | | | |
|---|---|---|---|---|
| 6,511,542 | B2 * | 1/2003 | Inagaki | 118/404 |
| 6,797,444 | B2 * | 9/2004 | Itami | 430/58.2 |
| 7,041,419 | B2 * | 5/2006 | Tokutake et al. | 430/58.2 |
| 7,094,511 | B2 * | 8/2006 | Yamada et al. | 430/96 |
| 7,261,991 | B2 * | 8/2007 | Yoshizawa et al. | 430/125.3 |
| 2004/0063014 | A1 * | 4/2004 | Yoshimura et al. | 430/59.6 |
| 2005/0053855 | A1 * | 3/2005 | Takegawa et al. | 430/66 |
| 2005/0202335 | A1 * | 9/2005 | Yoshizawa et al. | 430/124 |

FOREIGN PATENT DOCUMENTS

| | | |
|---|---|---|
| JP | A 64-070785 | 3/1989 |
| JP | A 03-103878 | 4/1991 |

* cited by examiner

*Primary Examiner* — Hoa Le
(74) *Attorney, Agent, or Firm* — Oliff & Berridge, PLC

(57) ABSTRACT

An image carrier includes a conductive base material and a photosensitive layer formed on the base material. The photosensitive layer has an outermost surface layer that contains particles having a number-averaged particle sphericality represented by Formula (1) of approximately 0.7 or less: sphericality=$4\pi A/L^2$ (1), where $\pi$ represents the circular constant, A represents the projection area of the particle, and L represents the peripheral length of the projected particle image.

7 Claims, 3 Drawing Sheets

IMAGE CARRIER, PROCESS CARTRIDGE AND IMAGE-FORMING APPARATUS

This application is based on and claims priority under 35 USC 119 from Japanese Patent Application 2007-024610 filed Feb. 2, 2007.

BACKGROUND (i) Technical Field

The invention relates to an image carrier having a photosensitive layer on a surface of which an electrostatic image is formed and a process cartridge and an image-forming apparatus containing the image carrier.

(ii) Related Art

Image-forming apparatuses such as a printer and a copying machine have been widely used, and the technology concerning various components for such image-forming apparatuses are also widely known. In image-forming apparatuses in electrophotographic process, among many image-forming apparatuses, a printing pattern is often formed by charging an image carrier such as a photoreceptor using an electrostatically charging unit and forming an electrostatic latent image different in electric potential from that of environment on the charged image carrier, and the electrostatic latent image thus formed is developed with a developer containing a toner and finally transferred onto a recording medium.

In an image-forming apparatus in the electrophotographic process, the image carrier has an important role of holding the original image,i.e., an electrostatic latent image, and allowing development of the electrostatic latent image. Recently, various process cartridges containing an image carrier and other components for image-forming apparatus such as an electrostatically charging unit are more readily available in the market. Such a cartridge is easier, for example, in maintenance, because a user can install multiple components including an image carrier in an image-forming apparatus together by installing a process cartridge in the image-forming apparatus.

In such a process cartridge, the performance of an image carrier may vary according to its storage condition before installation in image-forming apparatus. For example, when a process cartridge is stored under the environment subjected to frequent vibration, locally charged regions are formed on the image carrier surface by abrasion between the electrostatically charging unit and the image carrier and. As a result, irregularity in electrostatic property may occur on the image carrier surface. When the image carrier is used for image formation while there is irregularity in electrostatic property as described above, there may be some image-quality defects in the formed image, for example, caused by irregularity in density.

SUMMARY

In view of the circumstances above, the present invention provides an image carrier stabilized in electrostatic property, and a process cartridge and an image-forming apparatus containing such an image carrier for favorable image formation.

An image carrier according to an aspect of the invention includes:

a conductive base material; and a photosensitive layer formed on the base material, the photosensitive layer having an outermost surface layer that contains particles having a number-averaged particle sphericality represented by Formula (1) of approximately 0.7 or less:

$$\text{sphericality}=4\pi A/L^2 \quad (1),$$

where $\pi$ represents the circular constant, A represents a projection area of the particle, and L represents a peripheral length of a projected particle image.

BRIEF DESCRIPTION OF THE DRAWINGS

Exemplary embodiments of the present invention will be described in detail based on the following figures, wherein.

DETAILED DESCRIPTION

Hereinafter, exemplary embodiments of the present invention will be described.

Figure 1:
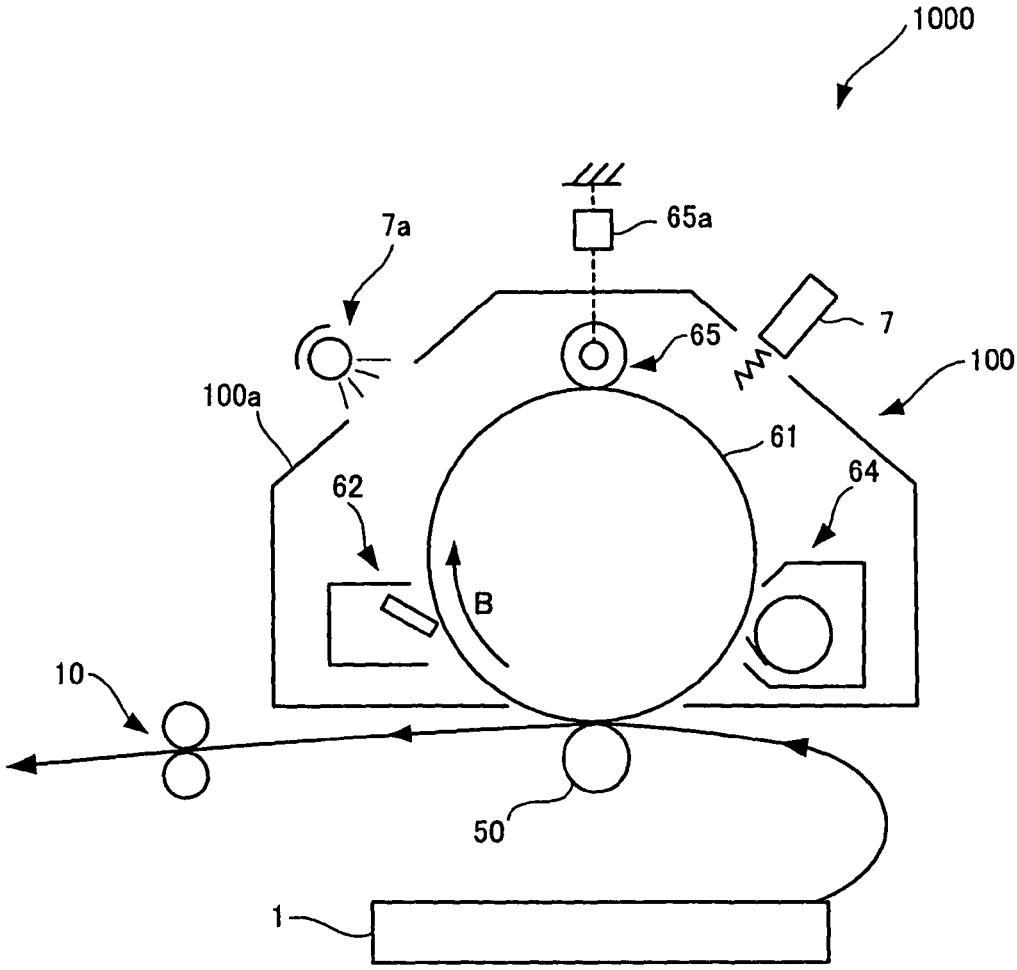
FIG. 1 is an overview illustrating the configuration of the image-forming apparatus in an exemplary embodiment of the invention.

FIG. 1 is an overall configurational view illustrating an exemplary embodiment of the image-forming apparatus according to the invention.

The image-forming apparatus 1000 is a monochromic single-sided printing printer in the electrophotographic process. The image-forming apparatus 1000 has an image carrier 61 that is a laminated image carrier in the electrophotographic process and revolves in the arrow B direction in the Figure, and an electrostatically charging unit 65 electrostatically charging the image carrier while revolving in contact with the image carrier 61 with the power supplied from a source 65*a*. The image carrier 61 corresponds to the image carrier according to the invention. The image-forming apparatus 1000 also has a photoirradiation unit 7 for emitting a laser beam to the image carrier 61 and thus forming an electrostatic latent image higher in potential than the periphery on the image carrier 61, a developing device 64 for forming a developed image by developing the electrostatic latent image by depositing a monochromic (black) toner, a transfer roll 50 for transferring the developed image by pressing a travelling paper onto the image carrier 61 carrying the developed image formed, a fixing unit 10 for fixing the transferred image on the paper by applying heat and pressure to the image transferred on the paper, a cleaning device 62 that is in contact with the image carrier 61 and cleans the toner remaining deposited on the image carrier 61 after transfer of the developed image, and an erase lamp 7*a* for removing the charge remaining on the image carrier 61 after transfer of the developed image. In the image-forming apparatus 1000, the electrostatically charging unit 65 and the image carrier 61 are both roll-shaped articles extending in the direction perpendicular to the face of FIG. 1, and both terminals of these rolls are connected to the supporting material 100*a* with respective rolls remaining rotatable. The cleaning device 62 and the developing device 64 are also connected to the supporting material 100*a*, and the electrostatically charging unit 65, the image carrier 61, the cleaning device 62, and the developing device 64 are integrated with the supporting material 100*a* to form a process cartridge 100. When the process cartridge is installed in the image-forming apparatus 1000, the image-forming apparatus 1000 is provided with respective units, that is, constituents of the process cartridge. The process cartridge 100 corresponds to the process cartridge according to the invention.

Hereinafter, the procedure of image formation in the image-forming apparatus 1000 will be described.

The image-forming apparatus 1000 has a toner cartridge (not shown) containing a black toner, which is supplied from the toner cartridge to the developing device 64. The paper onto which the developed image is transferred is stored in a tray 1, fed from the tray 1, upon an instruction for image formation by a user, to the transfer roll 50, where a developed image is transferred thereon, and then, conveyed in the direction leftward in the Figure. The paper-conveying route in FIG. 1 is shown as the route indicated by a leftward arrow, and the paper is conveyed along the paper-conveying route to the fixing unit 10, where the image transferred on the paper is fixed, and then output to the leftward direction.

Hereinafter, the configuration of the image carrier 61 shown in FIG. 1 will be described.

Figure 2:
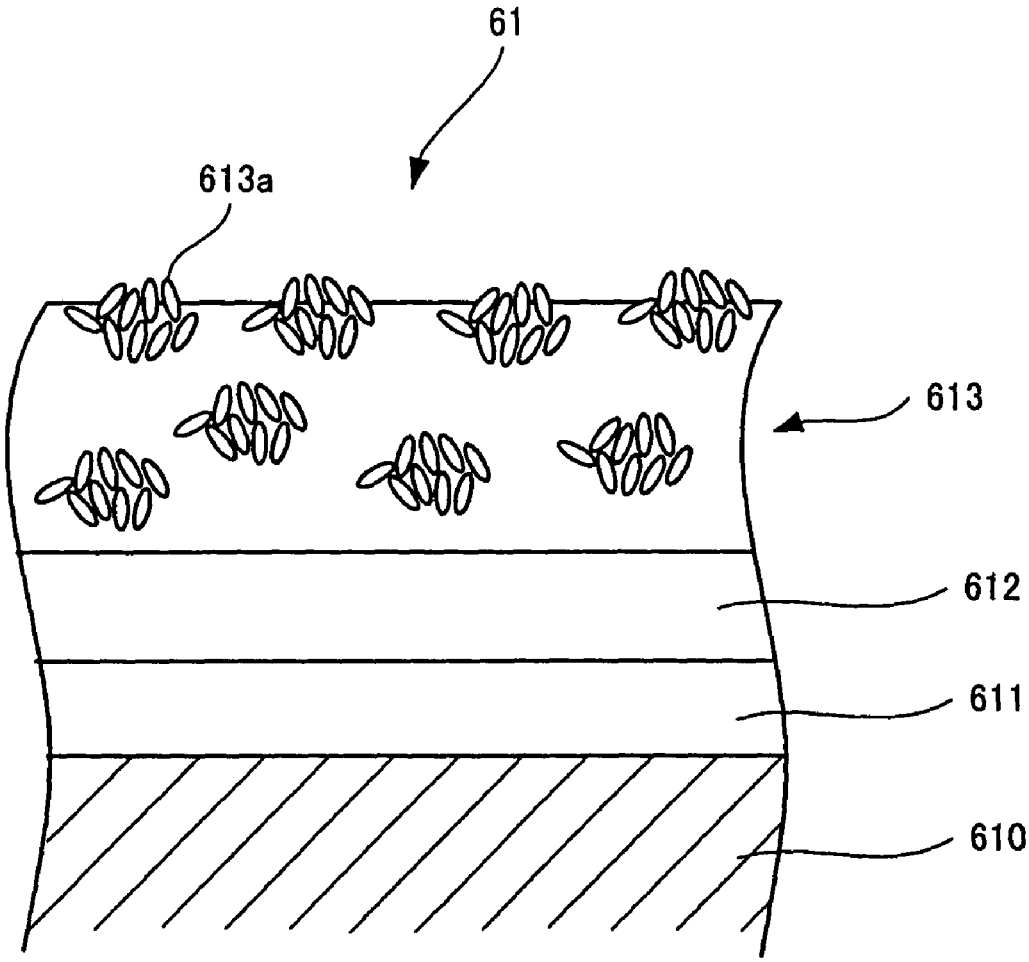
FIG. 2 is a schematic sectional view illustrating the layer structure of the image carrier shown in FIG. 1.

FIG. 2 is a schematic sectional view illustrating the layer structure of the image carrier shown in FIG. 1.

The image carrier 61 shown in FIG. 1 has a conductive base material 610, an undercoat layer 611 that prevents a beam entering the image carrier 61 from being reflected on the surface of the base material 610, a charge-generating layer 612 that generates a charged carrier upon receipt of the laser beam from the photoirradiation unit 7 shown in FIG. 1, and a charge-transporting layer 613 transporting the carrier. The layers of the image carrier 61 are laminated on the base material 610 in the described order. The combination of the undercoat layer 611, the charge-generating layer 612, and the charge-transporting layer 613 is an example of the photosensitive layer according to the invention.

Hereinafter, the charge-transporting layer 613, the charge-generating layer 612, the undercoat layer 611, and the base material 610 will be described separately.

The charge-transporting layer 613 is prepared by applying onto the charge-generating layer 612 a coating solution containing fluorine-resin particles, a charge-transporting material, and a binder resin that are added to a solvent and a fluorine-resin particle dispersant. The charge-transporting layer 613 is the outermost layer of the image carrier 61 shown in FIG. 1, and the charge-transporting layer 613 becomes in direct contact with the electrostatically charging unit 65 shown in FIG. 1.

Generally, the image carrier, when held in a state in contact with a device around the image carrier such as the electrostatically charging unit, may cause electrostatic irregularity on the image carrier surface by abrasion between the device and the image carrier, for example, by external vibration. In particular as in the process cartridge 100 in the present exemplary embodiment, in a process cartridge in which an image carrier and an electrostatically charging unit are integrated such that they are in contact with each other, electrostatic irregularity may occur on the image carrier surface more frequently, when the image carrier is transported before being installed in an image-forming apparatus. When the image carrier is used for image formation while there is still residual irregularity in electrostatic property as described above, there are more image-quality defects of irregularity in density generated in the formed image.

In the charge-transporting layer 613 of the present exemplary embodiment, irregular shaped particles 613*a* having an average sphericality of 0.7 or less are dispersed in the charge-transporting layer 613 for preventing such image-quality defects. The average sphericality will be described below. The average sphericality is determined in the following procedure.

An electron micrograph of a particle is obtained under a scanning electron microscope, and the area A and the peripheral length L of the projected image of the particle are determined by image analysis of the electron micrograph obtained in an image-analyzing apparatus. The number of the test particles is 100 or more. The particle sphericality is defined as a value obtained by dividing the projected-image area A by the area of the circle having the same circumference as peripheral length L. The area of the circle having the same circumference as the peripheral length L is represented by: $\pi\times(L/2\pi)^2$. Specifically, the particle sphericality is defined by the following Formula (1), by using the area A and the peripheral length L of the projected particle image:

$$\text{Particle sphericality}=4\pi A/L^2 \quad (1)$$

where, $\pi$ represents the circular constant (3.14); A represents the area of the projected particle image; and L represents the peripheral length of the projected particle image.

According to the definition of the sphericality, a particle closer to a sphere in shape has a sphericality of almost 1, while a particle less spherical in shape has a smaller sphericality. The average sphericality described above is a number-average particle sphericality obtained by determining the sphericality of 100 or more particles.

Irregular-shaped particles, such as particles 613*a* shown in FIG. 2, have a tendency to aggregate more frequently than spherical particles in the coating solution for the charge-transporting layer 613 described above. For these properties, when a coating solution containing irregular-shaped particles is used for forming the charge-transporting layer, the surface of the charge-transporting layer prepared (i.e., of the image carrier surface) becomes rougher than when spherical particles are used, because of the presence of aggregate particles. The resulting decrease of the contact area with the electrostatically charging unit leads to decrease of the electrostatic irregularity formed on the image carrier surface even under vibration-rich environment.

The charge-transporting layer 613 in the present exemplary embodiment contains particles 613*a* having an average sphericality of 0.7 or less and a primary particle diameter (volume-average primary diameter) of approximately 0.2 μm in the charge-transporting layer 613 in an amount of 4.5 weight % or more and 7.5 weight % or less. As a result, the charge-transporting layer 613 favorably has a center-line average roughness (Ra) specified in JIS B0601 ('82) (hereinafter, simply referred to as surface roughness (Ra)) in the range of 0.1 μm or more and 0.5 μm or less, as its surface property. When the roughness curve (line indicating surface-irregularity shape) is folded at the center line (line showing average irregularity) in a particular region at a length of Ln, the surface roughness (Ra) is defined as an amount obtained by dividing the area of the region between the roughness curve and the center line by the length Ln. The length Ln is 5 mm in the present exemplary embodiment. Specifically, it is determined by using a contact surface-roughness analyzer Surfcom 1,400 A (manufactured by Tokyo Seimitsu Co. Ltd.) at a test-piece length Ln of 5 mm. For example, the measuring condition for each region is as follows: test length Ln: 5 mm, standard length L: 0.8 mm, and cutoff value: 0.8 mm.

When the surface roughness (Ra) of the image carrier is less than 0.1 μm, the contact area between the image carrier and the electrostatically charging unit increases, often causing electrostatic irregularity on the image carrier surface by vibration. On the other hand, when the surface roughness of the image carrier (Ra) is larger than 0.5 μm, the particles are separated after repeated image forming, leaving linear scratches on the surface of the charge-transporting layer and linear image defects in the formed image. When the surface roughness of the image carrier (Ra) is in the range of 0.1 μm or more and 0.5 μm or less, the linear image defect and the image-quality defect by electrostatic irregularity are prevented favorably.

In the present exemplary embodiment, a fluorine-based resin is used as the material for the particles 613*a*.

It would be possible to reduce the friction coefficient and improve durability to abrasion and scratching, by making the surface of the charge-transporting layer 613 contain particles of a fluorine resin. In addition, decrease in friction force between the toner and the surface layer would make removal of the toner from blade easier and improve the cleaning efficiency, because the friction force between the toner and the blade in the cleaning unit remain unchanged.

The primary particle diameter of the particles 613*a* (volume-average primary diameter) is preferably in the range of 0.05 μm or more and 1 μm or less, more preferably, 0.1 μm or more and 0.5 μm or less. A primary particle diameter of less than 0.05 μm leads to increased aggregation effect in the coating solution and an excessively coarse surface of the formed charge-transporting layer 613. On the other hand, a primary particle diameter of more than 1 μm often causes the image defects by shielding of the writing light.

The fluorine resin particle for use in the invention may be prepared favorably by emulsion polymerization. For example, in the case of a tetrafluoroethylene resin, water, an initiator, an emulsifier, a fluorochemical surfactant and others are placed in a high-pressure autoclave; and after deaeration, a raw material tetrafluoroethylene is continuously supplied into the mixture at 0° C. or higher and 120° C. or lower and at a pressure of 1 to 50 atmospheric pressures while stirred under pressure, allowing reaction. After reaction, the latex obtained is allowed to coagulate, washed, and dried, to give desired fluorine resin particles. To obtain fluorine resin particles having an average sphericality of 0.7 or less, it is preferably to terminate the coagulation at an appropriate point in the coagulation step before the particle changes its shape from undefined to spherical. Specifically, it is possible to obtain particles in undefined shape, thus particles having a smaller average sphericality, by raising the heating speed, lowering the liquid temperature, and shortening the coagulation period. However, although the production condition may be controlled in the step of producing the fluorine resin particles, if the facility investment or the labor for such control is ineffective and unrewarding, particles having a desirable average sphericality may be obtained by selection from various lots of particles. An example of the simple lot-selecting method is a method that the apparent density or the median diameter of secondary particles is used as a surrogate indicator. The apparent density is determined according to the method similar to that specified in JIS K6891, and particles having a large apparent density are likely to have a smaller average sphericality. The median diameter of secondary particles is determined by laser diffraction scattering while using dry fluorine resin particles, and particles having a larger secondary particle diameter are likely to have a smaller average sphericality. The fluorine resin particles used in the following Examples are those obtained by lot selection.

Examples of the charge-transporting materials used in the coating solution for the charge-transporting layer 613 include oxadiazole derivatives such as 2,5-bis(p-diethylaminophenyl)-1,3,4-oxadiazole; pyrazoline derivatives such as 1,3,5-triphenyl-pyrazoline and 1-[pyridyl-(2)]-3-(p-diethylaminostyryl)-5-(p-diethylaminostyryl)pyrazoline; aromatic tertiary aminated compounds such as triphenylamine, N,N'-bis(3,4-dimethylphenyl)biphenyl-4-amine, tri(p-methylphenyl)aminyl-4-amine, and dibenzylaniline; aromatic tertiary diaminated compounds such as N,N'-bis(3-methylphenyl)-N,N'-diphenylbenzidine; 1,2,4-triazine derivatives such as 3-(4'-dimethylaminophenyl)-5,6-di-(4'-methoxyphenyl)-1,2,4-triazine; hydrazone derivatives such as 4-diethylaminobenzaldehyde-1,1-diphenyl hydrazone; quinazoline derivatives such as 2-phenyl-4-styryl-quinazoline; benzofuran derivatives such as 6-hydroxy-2,3-di(p-methoxyphenyl) benzofuran; α-stilbene derivatives such as p-(2,2-diphenylvinyl)-N,N-diphenylaniline; enamine derivatives, carbazole derivatives such as N-ethyl carbazole; hole-transporting materials such as poly-N-vinylcarbazole and the derivatives thereof; quinone compounds such as chloranil and bromoanthraquinone; tetracyanoquinodimethane compounds, fluorenone compounds such as 2,4,7-trinitrofluorenone, and 2,4,5,7-tetranitro-9-fluorenone; polymers having an electron-transporting substance such as a xanthone or thiophene compound or a group containing the group consisted of the compounds above on the main or side chain; and the like. These charge-transporting materials may be used alone or in combination of two or more.

Examples of the binder resins used in the coating solution for the charge-transporting layer 613 include polycarbonate resins such as of bisphenol A type and bisphenol Z type; insulative resins including acrylic resins, methacrylic resins, polyarylate resins, polyester resins, polyvinyl chloride resins, polystyrene resins, acrylonitrile-styrene copolymer resins, acrylonitrile-butadiene copolymer resins, polyvinyl acetate resins, polyvinylformal resins, polysulfone resins, styrene-butadiene copolymer resins, vinylidene chloride-acrylonitrile copolymer resins, vinyl chloride-vinyl acetate-maleic anhydride resins, silicone resins, phenol-formaldehyde resins, polyacrylamide resins, polyamide resins, and chlorine rubber; organic photoconductive polymers such as polyvinyl carbazole, polyvinylanthracene, and polyvinyl pyrene; and the like. The blending rate of the charge-transporting material to the binder resin is preferably 10:1 to 1:5.

The solvent used in preparing the charge-transporting layer is not particularly limited if it dissolves the binder resin, and examples thereof include aromatic hydrocarbon solvents such as toluene and chlorobenzene; aliphatic alcohol solvents such as methanol, ethanol, n-propanol, iso-propanol, and n-butanol; ketone solvents such as acetone, cyclohexanone, and 2-butanone; halogenated aliphatic hydrocarbon solvents such as methylene chloride, chloroform, and ethylene chloride; cyclic or straight-chain ether solvents such as tetrahydrofuran, dioxane, ethylene glycol, and diethylether; ester solvents such as methyl acetate, ethyl acetate, and n-butyl acetate; and the like, and these solvents may be used alone or in combination of two or more.

A fluorochemical surfactant or a fluorine-based graft polymer may be used as the dispersion stabilizer for the fluorine resin particles. Among fluorine-based graft polymers, macromonomers of an acrylic ester compound, a methacrylic ester compound, a styrene compounds or the like, and resins prepared by graft polymerization of a perfluoroalkylethyl methacrylate are favorable. The content of the fluorochemical surfactant or the fluorine-based graft polymer is preferably in the range of 1 weight % or more and 5 weight % or less with respect to the weight of the fluorine resin particles. The fluorine resin particles are dispersed in the coating solution, for example, in a medium dispersing machine such as ball mill, vibration ball mill, atriter (stirrer-type ball mill), sand mill, or horizontal sand mill, or a mediumless dispersing machine such as agitator, an ultrasonic dispersing machine, roll mill, or high-pressure homogenizer. The high-pressure homogenizers include collision-type homogenizers further dispersing the crude dispersion by liquid-liquid collision or liquid-wall collision under high pressure and penetration-type homogenizer dispersing liquid by passage through fine channels under high pressure, and the like.

The coating solution for charge-transporting layer may be coated on the charge-generating layer 5 by any one of common methods such as dip coating, upward punch coating, wire bar coating, spray coating, blade coating, knife coating, and curtain coating. The thickness of the charge-transporting layer is preferably in the range of 5 μm or more and 50 μm or less, more preferably in the range of 10 μm or more and 40 μm or less.

The charge-generating layer 612 contains a charge-generating substance that generates an electric charge upon photo-(electromagnetic) irradiation at a predetermined wavelength, as it is dispersed in a binder resin. A phthalocyanine pigment such as nonmetal phthalocyanine, chlorogallium phthalocyanine, hydroxygallium phthalocyanine, dichlorotin phthalocyanine, or titanyl phthalocyanine may be used as the charge-generating substance. In particular, preferable are chlorogallium phthalocyanine crystal showing strong diffraction (Bragg reflection) peaks to CuK α characteristic X-ray at least at Bragg angles (2θ±0.2°) of 7.4°, 16.6°, 25.5° and 28.3°; nonmetal phthalocyanine crystal showing strong diffraction peaks to CuK α characteristic X-ray at least at Bragg angles (2θ±0.2°) of 7.7°, 9.3°, 16.9°, 17.5°, 22.4° and 28.8°; hydroxygallium phthalocyanine crystal showing strong diffraction peaks to CuK α characteristic X-ray at least at Bragg angles (2θ±0.2°) of 7.5°, 9.9°, 12.5°, 16.3°, 18.6°, 25.1° and 28.3°; and titanyl phthalocyanine crystal showing strong diffraction peaks to CuK α characteristic X-ray at least at Bragg angles (2θ±0.2°) of 9.6°, 24.1° and 27.2. Other examples of the charge-generating substances include quinone pigments, perylene pigments, indigo pigments, bisbenzimidazole pigments, anthrone pigments, quinacridone pigments, and the like. Examples of the binder resins used in the charge-generating layer 612 include polycarbonate resins such as of bisphenol A type and bisphenol Z type; acrylic resins, methacrylic resins, polyarylate resins, polyester resins, polyvinyl chloride resins, polystyrene resins, acrylonitrile-styrene copolymer resins, acrylonitrile-butadiene copolymers, polyvinyl acetate resins, polyvinylformal resins, polysulfone resins, styrene-butadiene copolymer resins, vinylidene chloride-acrylonitrile copolymer resins, vinyl chloride-vinyl acetate-maleic anhydride resins, silicone resins, phenol-formaldehyde resins, polyacrylamide resins, polyamide resins, poly-N-vinylcarbazole resins, and the like. The blending ratio of the charge-generating substance to the binder resin is preferably in the range of 10:1 to 1:10.

The undercoat layer 611 has a role to prevent reflection of the light from the surface of the base material 610 and also a role to prevent undesirable carrier from the base material 610 from flowing into the charge-generating layer 612 or the charge-transporting layer 613. The undercoat layer 611 is formed by coating the base material 610 with conductive material powder dispersed in a binder resin on. Examples of the conductive materials used in the undercoat layer 611 include metals such as aluminum, copper, nickel, and silver; conductive metal oxides such as antimony oxide, indium oxide, tin oxide, titanium oxide, and zinc oxide; and nonmetal conductive materials such as carbon fiber, carbon black, and graphite powder. Examples of the binder resins include known polymer resin compounds including acetal resins such as polyvinylbutyral, polyvinylalcohol resins, casein, polyamide resins, cellulosic resins, gelatin, polyurethane resins, polyester resins, methacrylic resins, acrylic resins, polyvinyl chloride resins, polyvinyl acetate resins, vinyl chloride-vinyl acetate-maleic anhydride resins, silicone resins, silicone-alkyd resins, phenol resins, phenol-formaldehyde resins, melamine resins, and urethane resins; conductive resins such as electric charge-transporting resins containing electric charge-transporting group and polyaniline; and the like. Among these resins, a resin that is insoluble in the coating solvents used for preparation of the charge-generating layer 612 and the charge-transporting layer 613 over the undercoat layer 611 is preferable, and such resins including phenol resins, phenol-formaldehyde resins, melamine resins, urethane resins, and epoxy resins having such property are preferable as the binder resin for the undercoat layer 611.

The image carrier according to the invention may have an additional intermediate layer for improving adhesiveness between the undercoat layer 611 and the charge-generating layer 612.

Examples of the materials for the base material 610 include metals such as aluminum, nickel, chromium, and stainless steel. Alternatively, plastic films having a deposited metal film of such a metal, gold, vanadium, oxidation tin, indium oxide, or ITO are also favorable, and paper, plastic films and the like coated or impregnated with a conductivity-enhancing agent are also favorable as the material for the base material 610.

Hereinafter, an image-forming apparatus according to the invention in an other exemplary embodiment of the invention, which is different from the image-forming apparatus 1000 shown in FIG. 1, will be described.

Figure 3:
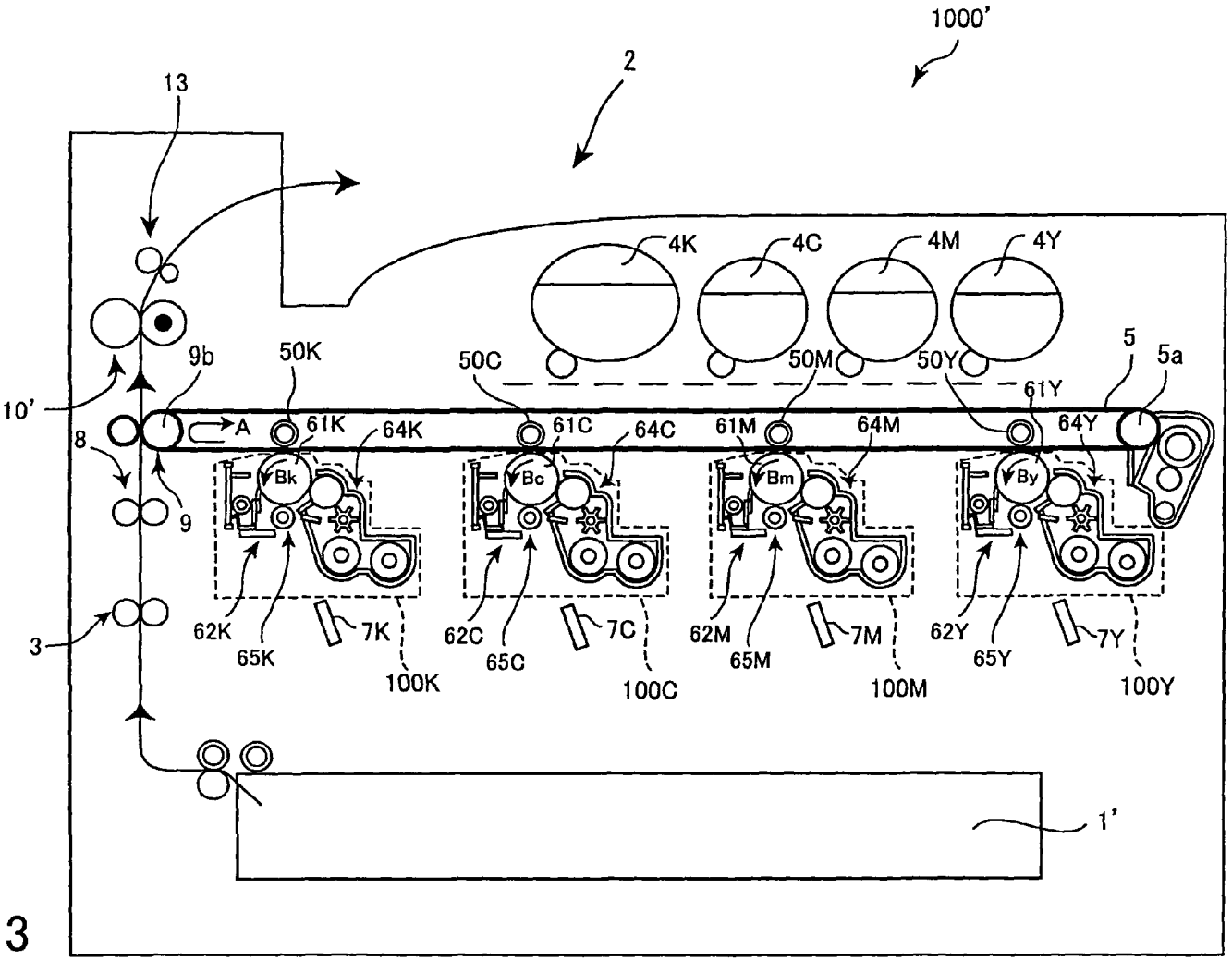
FIG. 3 is an overview illustrating an image-forming apparatus in another exemplary embodiment of the invention.

FIG. 3 is an overall view illustrating the configuration of the image-forming apparatus in another exemplary embodiment of the invention.

An image-forming apparatus 1000' in the embodiment is a single-side-output color printer.

An image-forming apparatus 1000' has laminated image carriers 61K, 61C, 61 M, and 61Y in the electrophotographic process, respectively revolving in the directions indicated by arrows Bk, Bc, Bm, By in the Figure. Each of the image carriers 61K, 61C, 61M, and 61Y corresponds to the image carrier according to the invention. Each image carrier has: an electrostatically charging unit 65K, 65C, 65M, or 65Y that charges each image carrier while revolving in contact with the image carrier; a photoirradiation unit 7K, 7C, 7M, or 7Y that forms an electrostatic latent image in black (K), cyan (C), magenta (M), or yellow (Y) on the charged image carrier by irradiation laser beam; and a developing device 64K, 64C, 64M, or 64Y that forms a developed image in various colors by developing the electrostatic latent image formed on the image carrier with developers containing respective color toners. Among the respective components in the image-forming apparatus 1000', the electrostatically charging unit 65K, the image carrier 61K, a cleaning device 62K, and the developing device 64K for black image are integrated into a process cartridge 100K, and similarly, the electrostatically charging unit 65C, the image carrier 61C, a cleaning device 62C, and the developing device 64C for cyan image, the electrostatically charging unit 65M, the image carrier 61M, a cleaning device 62M, and the developing device 64M for magenta image, and, the electrostatically charging unit 65Y, the image carrier 61Y, a cleaning device 62Y, and the developing device 64Y for yellow image are integrated respectively into process cartridges 100C, 100M, and 100Y. When four process cartridges are installed in the image-forming apparatus 1000', respective units, that is, constituents of these process cartridges, are installed in the image-forming apparatus 1000'. Each of these process cartridges 100K, 100C, 100M, and 100Y corresponds to the process cartridge in the invention.

The image-forming apparatus 1000' also has an intermediate transfer belt 5 conveying the primary transfer image after receiving transfer of the image developed in various colors formed on each image carrier, primary transfer rolls 50K, 50C, 50M, and 50Y primarily transferring the developed image in various colors onto the intermediate transfer belt 5, a secondary transfer roll pair 9 secondarily transferring the image onto paper, a fixing unit 10' fixing the secondary transferred image on paper, four toner cartridges 4K, 4C, 4M, and 4Y supplying color toners in respective colors respectively to the four developing device, and a tray 1' storing the paper. The intermediate transfer belt 5 travels in the arrow A direction in the Figure, as driven by a drive roll 5*a* and stretched around the secondary transfer roll 9*b* and the drive roll 5*a*.

Hereinafter, the procedure of forming an image in the image-forming apparatus 1000' will be described.

The four image carrier 61K, 61C, 61M, and 61Y are charged respectively by the electrostatically charging unit 65K, 65C, 65M, and 65Y and give electrostatic latent images on respective carriers by the irradiation laser beams from photoirradiation units 7K, 7C, 7M, and 7Y. The electrostatic latent images are developed into developed images in various colors respectively in developing devices 64K, 64C, 64M, and 64Y with developers containing respective color toners. The developed images thus formed in various colors are transferred and laminated onto an intermediate transfer belt 5 one by one in the order of yellow (Y), magenta (M), cyan (C), and black (K), by primary transfer rolls 50K, 50C, 50M, and 50Y corresponding to various colors. Then, a multi-color primary-transfer image is formed. The multi-color primary-transfer image is conveyed by the intermediate transfer belt 5 to the position of the secondary transfer roll pair 9. On the other hand, in response to formation of the multi-color primary-transfer image, a sheet of paper is withdrawn from the tray 1', conveyed by a conveyor roll 3 and located at a suitable position by a register roll pair 8. The multi-color primary transfer image described above is then transferred onto the paper (secondary transfer) by the secondary transfer roll pair 9 and the secondary transfer image on the paper is fixed by the fixing unit 10'. After fixing, the paper carrying the fixed image is output to a paper output tray 2 through a feed roll pair 13.

The image is formed in this way in the image-forming apparatus 1000'.

Each of the four image carriers 61K, 61C, 61M, and 61Y in the image-forming apparatus 1000' has the same configuration as that of the image carrier 61 shown in FIG. 2, and irregular-shaped particles 613*a* shown in FIG. 2 are dispersed in the charge-transporting layer of each image carrier. The surface of the image carrier is coarser than that of the image carrier containing spherical fluorine resin particles, because of the particles 613*a*, and thus, the image carrier is less vulnerable to electrostatic irregularity even under vibration-rich environment. See the description in FIG. 2 for details of the configuration of each four image carrier 61K, 61C, 61M, or 61Y, as description thereof is omitted.

Hereinafter, with reference to experiment data, how an image carrier having the configuration shown in FIG. 2 is resistant to generation of image defects during image formation will be described.

EXAMPLE 1

100 parts by weight of zinc oxide (average particle diameter: 70 nm, manufactured by Tayca Corporation, specific surface area: 15 $m^2/g$) is agitated with 500 parts by weight of tetrahydrofuran; 1.25 parts by weight of a silane-coupling agent KBM603 (manufactured by Shin-Etsu Chemical Co., Ltd.) is added thereto; and the mixture is stirred for 2 hours. Then, tetrahydrofuran is removed by distillation under reduced pressure, and the residue is baked at 120° C. for 3 hours, to give zinc oxide fine particles surface-treated with a silane-coupling agent. 38 parts by weight of a solution containing 60 parts by weight of the zinc oxide fine particles obtained, 0.6 part by weight of alizarin, 13.5 parts by weight of a hardening agent blocked isocyanate (Sumidur BL3175, manufactured by Sumitomo Bayer Urethane Co.,Ltd.), and 15 parts by weight of a butyral resin (S-LEC BM-1, manufactured by Sekisui Chemical Co.,Ltd.) dissolved in 85 parts by weight of methylethylketone are mixed with 25 parts by weight of methylethylketone, and the mixture is dispersed in a sand mill by using glass beads having a diameter of 1 mm for 4 hours, to give a dispersion. 0.005 part by weight of a catalyst dioctyltin dilaurate and 4.0 parts by weight of silicone resin particles (Tospearl 145, manufactured by GE Toshiba Silicones) are added to and mixed with the dispersion obtained, to give an undercoat layer-coating solution. The coating solution is applied on an aluminum substrate having a diameter of 30 mm by dip coating and dried and hardened at 180° C. for 40 minutes, to give an undercoat layer having a thickness of 25 μm.

Then, a mixture of 15 parts by weight of a charge-generating substance, chlorogallium phthalocyanine crystal having strong diffraction peak to CuK α characteristic X-ray at Bragg angles (2θ±0.2°) of at least 7.4°, 16.6°, 25.5° and 28.3°, 10 parts by weight of a vinyl chloride-vinyl acetate copolymer resin (VMCH, manufactured by Nippon Unicar Co., Ltd.) and 300 parts by weight of n-butyl alcohol is dispersed in a sand mill by using glass beads having a diameter of 1 mm for 4 hours, to give a coating solution for a charge-generating layer. The charge-generating layer-coating solution is applied on the undercoat layer described above by dip coating, and dried, to give a charge-generating layer having a thickness of 0.2 μm.

Then, 0.5 part by weight of ethylene tetrafluoride resin particles (average diameter: 0.2 μm), 0.01 part by weight of a fluorine-based graft polymer, 4 parts by weight of tetrahydrofuran, and 1 part by weight of toluene are mixed and stirred thoroughly, to give an ethylene tetrafluoride resin particle suspension. Then, 4 parts by weight of a charge-transporting substance N,N'-diphenyl-N,N'-bis(3-methylphenyl)-[1,1']-biphenyl-4,4'-diamine, 6 parts by weight of a bisphenol Z polycarbonate resin (viscosity average molecular weight: 40,000) and 0.1 part by weight of an antioxidant 2,6-di-t-butyl-4-methylphenol are mixed with each other to dissolve 24 parts by weight of tetrahydrofuran and 11 parts by weight of toluene. The ethylene tetrafluoride resin particle suspension described above is added to the solution; the mixture was agitated thoroughly; and the mixture is dispersed in a high-pressure homogenizer (manufactured by Yoshida Kikai Co., Ltd.) equipped with a fine-channel penetration chamber at an elevated pressure of 500 $kgf/cm^2$ (4904 $N/cm^2$) repeatedly for six times, to give a coating solution for forming a charge-transporting layer. The average sphericality of the ethylene tetrafluoride resin particle sample is determined then by the method described above. As a result, the average sphericality is 0.68.

The charge-transporting layer-coating solution is applied on the charge-generating layer and dried at 115° C. for 40 minutes, forming a charge-transporting layer having a thickness of 30 μm, to give a complete electrophotography photo receptor. Among the components in the charge-transporting layer-coating solution, tetrahydrofuran and toluene are removed by vaporization during drying at 115° C. for 40 minutes, and the content (weight %) of the ethylene tetrafluoride resin particles in the formed charge-transporting layer is calculated to be 4.7 weight % from the composition of the charge-transporting layer-coating solution. The surface roughness (Ra) of the charge-transporting layer (i.e., the surface roughness of the electrophotography photoreceptor) is also determined. As a result, Ra is 0.14 μm.

Then, the photoreceptor obtained by the above method is used as the photoreceptor of the drum cartridge in a full color printer DocuCentre Color f450 manufactured by Fuji Xerox Co., Ltd. containing components similar to those contained in the process cartridges 100K, 100C, 100M, and 100Y shown in FIG. 3, and the drum cartridge is stored for two weeks under an environment in which the cartridge is subjected to vibration similar in scale and frequency to that of the drum cartridge during transportation. The environment is kept at a high temperature of 45° C. and a high humidity of 90% RH. The drum cartridge after storage for 2 weeks is placed in a full color printer DocuCentre Color f450 manufactured by Fuji Xerox Co., Ltd. for image output, and the irregularity in density in the output image is examined. Separately, another photoreceptor prepared by the method for preparing the above is used similarly as the photoreceptor of the drum cartridge in a full color printer DocuCentre Color f450 manufactured by Fuji Xerox Co., Ltd., and the drum cartridge is stored under an environment in which the cartridge is subjected to vibration similar in scale and frequency to that of the drum cartridge during transportation and kept at a low temperature of 10° C. and a low humidity of 15% RH for 2 weeks. After storage for 2 weeks, the drum cartridge stored is installed in the full color printer DocuCentre Color f450 manufactured by Fuji Xerox Co., Ltd. for image output, and the image-quality defects caused by irregularity in density in the output image is examined.

By examining the image-quality defects caused by irregularity in density, it is possible to detect the electrostatic irregularity on the photoreceptor surface generated by abrasion between the photoreceptor and the electrostatically charging unit during storage of the drum cartridge. Because the temperature of the photoreceptor during transportation is often in the range of about 10° C. or higher and 45° C. or lower and the humidity in the range of 15% RH or more and 90% RH or less, it is possible to detect the electrostatic irregularity on the photoreceptor surface after exposure to vibration for an extended period during transportation, by carrying out the image output tests after storage under the above two kinds of environments.

Further, a new photoreceptor prepared by the above method is used as the photoreceptor in a full color printer DocuCentre Color f450 manufactured by Fuji Xerox Co., Ltd., and is subjected to an output test under an environment at a temperature of 28° C. and a humidity of 85% RH, in which images having an image density of 5% in various colors including single-dot line image are printed on 50,000 sheets of A4-sized paper. And, presence of a linear image defect in the 50,000th image is examined by visual observation.

The linear image defect is a phenomenon often observed when aggregates of ethylene tetrafluoride resin particles in the charge-transporting layer are separated from the photoreceptor surface during repeated image formation. Thus, examining the linear image defect allows for detecting whether the linear image defect is caused by an excessive amount of the aggregates of ethylene tetrafluoride resin particles contained in the charge-transporting layer.

EXAMPLE 2

An electrophotography photoreceptor is prepared in a similar manner to Example 1, except that ethylene tetrafluoride resin particles having an average sphericality of 0.66 are used. Accordingly, the content (weight %) of the ethylene tetrafluoride resin particles in the charge-transporting layer of the photoreceptor is 4.7 weight %, similarly to Example 1, but, because the average sphericality is smaller than that in Example 1, the surface roughness (Ra) is larger at 0.18 μm than that in Example 1. Tests on image defects caused by irregularity in density and linear image defects similar to those in Example 1 are carried out by using this photoreceptor.

EXAMPLE 3

An electrophotography photoreceptor is prepared in a similar manner to Example 1, except that ethylene tetrafluoride resin particles having an average sphericality of 0.62 are used. Accordingly, the content (weight %) of the ethylene tetrafluoride resin particles in the charge-transporting layer of the photoreceptor is 4.7 weight %, similarly to Examples 1 and 2, but, because the average sphericality is further smaller than that in Example 2, the surface roughness (Ra) is larger at 0.24 μm than that in Example 2. Tests on image defects caused by irregularity in density and linear image defects similar to those in Example 1 are carried out by using this photoreceptor.

EXAMPLE 4

An electrophotography photoreceptor is prepared in a similar manner to Example 1, except that the content (weight %) of ethylene tetrafluoride resin particles in the charge-transporting layer is 7.3 weight %. Accordingly, the average sphericality of the ethylene tetrafluoride resin particle in the charge-transporting layer of the photoreceptor is the same as that in Example 1 at 0.68, but, because the content of the ethylene tetrafluoride resin particles is higher than that in Example 1, the surface roughness (Ra) is larger at 0.40 μm than that in Example 1. Tests on image defects caused by irregularity in density and linear image defects similar to those in Example 1 are carried out by using this photoreceptor.

EXAMPLE 5

An electrophotography photoreceptor is prepared in a similar manner to Example 1, except that the content (weight %) of ethylene tetrafluoride resin particles in the charge-transporting layer is 9.0 weight %. Accordingly, the average sphericality of the ethylene tetrafluoride resin particle in the charge-transporting layer of the photoreceptor is the same as that in Example 1 at 0.68, but, because the content of the ethylene tetrafluoride resin particles is higher than that in Example 4, the surface roughness (Ra) is larger at 0.75 μm than that in Example 4. Tests on image defects caused by irregularity in density and linear image defects similar to those in Example 1 are carried out by using the photoreceptor.

EXAMPLE 6

An electrophotography photoreceptor is prepared in a similar manner to Example 1, except that the content (weight %) of ethylene tetrafluoride resin particles in the charge-transporting layer is 3.8 weight %. Accordingly, the average sphericality of the ethylene tetrafluoride resin particles in the charge-transporting layer of the photoreceptor is the same as that in Example 1 at 0.68, but, because the content of the ethylene tetrafluoride resin particles is lower than that in Example 1, the surface roughness (Ra) is smaller at 0.06 μm than that in Example 1. Tests on image defects caused by irregularity in density and linear image defects similar to those in Example 1 are carried out by using this photoreceptor.

COMPARATIVE EXAMPLE 1

An electrophotography photoreceptor is prepared in a similar manner to Example 1, except that ethylene tetrafluoride resin particles having an average sphericality of 0.98 are used. Accordingly, although the content (weight %) of the ethylene tetrafluoride resin particles in the charge-transporting layer of the photoreceptor is the same at 4.7 weight % as that in Example 1, because the average sphericality is higher than that in Example 1, the surface roughness (Ra) becomes smaller at 0.02 μm than that in Example 1. Tests on image defects caused by irregularity in density and linear image defects similar to those in Example 1 are carried out by using this photoreceptor.

COMPARATIVE EXAMPLE 2

An electrophotography photoreceptor is prepared in a similar manner to Example 1, except that ethylene tetrafluoride resin particles having an average sphericality of 0.82 are used. Accordingly, although the content (weight %) of the ethylene tetrafluoride resin particles in the charge-transporting layer of the photoreceptor is the same at 4.7 weight % as that in Example 1 and Comparative Example 1, because the average sphericality is higher than that in Example 1 and smaller than Comparative Example 1, the surface roughness (Ra) is smaller at 0.05 μm than that in Example 1 and larger than that in Comparative Example 1. Tests on image defects caused by irregularity in density and linear image defects similar to those in Example 1 are carried out by using this photoreceptor.

COMPARATIVE EXAMPLE 3

An electrophotography photoreceptor is prepared in a similar manner to Example 1, except that ethylene tetrafluoride resin particles having an average sphericality of 0.98 and a content (weight %) in the charge-transporting layer of 9.0 weight % are used. Accordingly, although the average sphericality of the ethylene tetrafluoride resin particle in the charge-transporting layer of the photoreceptor is the same at 0.98 as that in Comparative Example 1, because the content in the charge-transporting layer is higher than that in Comparative Example 1, the surface roughness (Ra) is greater at 0.60 μm than that in Comparative Example 1. Tests on image defects caused by irregularity in density and linear image defects similar to those in Example 1 are carried out by using this photoreceptor.

The average sphericality and the content (weight %) of the ethylene tetrafluoride resin particle contained in the charge-transporting layer of the photoreceptor, the surface roughness (Ra) of charge-transporting layer, and, results of the test on image defects caused by irregularity in density and linear image defects in Examples 1 to 6, and Comparative Examples 1 to 3 above are summarized respectively in the following Table 1.

TABLE 1

| | Average sphericality | Content (weight %) of resin particles | Surface roughness (Ra) (μm) | Linear image-quality defect | Image defect by irregularity in density: Temperature: 45° C. Humidity: 90% RH | Image defect by irregularity in density: Temperature: 10° C. Humidity: 15% RH |
|---|---|---|---|---|---|---|
| Example 1 | 0.68 | 4.7% | 0.14 | No | No | |
| Example 2 | 0.66 | | 0.18 | | | |
| Example 3 | 0.62 | | 0.24 | | | |
| Example 4 | 0.68 | 7.3% | 0.40 | | | |
| Example 5 | | 9.0% | 0.75 | Yes | No | |
| Example 6 | | 3.8% | 0.06 | No | Yes | Yes |
| Comparative Example 1 | 0.98 | 4.7% | 0.02 | No | Yes | Yes |
| Comparative Example 2 | 0.82 | | 0.05 | No | Yes | Yes |
| Comparative Example 3 | 0.98 | 9.0% | 0.60 | Yes | No | |

When the ethylene tetrafluoride resin particles having an average sphericality of 0.7 or less in Examples 1 to 3 and the ethylene tetrafluoride resin particles having an average sphericality of 0.8 or more in Comparative Examples 1 and 2 are compared, the particles in Comparative Examples 1 and 2 cause image-quality defect by irregularity in density both under high-temperature high-humidity environment and low-temperature low-humidity environment, while the particles in Examples 1 to 3 do not cause the image-quality defect by irregularity in density.

Generally, when the content (weight %) of resin particles is the same, decrease of the average sphericality of ethylene tetrafluoride resin particles leads to increase of the surface roughness (Ra) and decrease of the contact area between the photoreceptor and the electrostatically charging unit during storage.

The content of ethylene tetrafluoride resin particles is 4.7 weight % all in Examples 1 to 3 and Comparative Examples 1 and 2, but the surface roughness (Ra) is 0.05 μm or less in Comparative Examples 1 and 2 where the average sphericality of ethylene tetrafluoride resin particles is 0.8 or more, while the surface roughness (Ra) is 0.1 μm or more in Examples 1 to 3 where the average sphericality of ethylene tetrafluoride resin particles used is 0.7 or less. The results of the image-quality defect by irregularity in density reflect the difference in surface roughness (Ra) and show that an average sphericality of ethylene tetrafluoride resin particles contained in the charge-transporting layer at 0.7 or less, which leads to larger surface roughness (Ra), is favorable for prevention of the image-quality defect caused by irregularity in density.

When Examples 1 and 6, in which the ethylene tetrafluoride resin particles have the same average sphericality of 0.68 but are different in content, are compared, Example 6, in which the content of ethylene tetrafluoride resin particle is 3.8 weight %, shows the image-quality defect by irregularity in density both under high-temperature, high-humidity environment and low-temperature low-humidity environment, while Example 1, in which the content of ethylene tetrafluoride resin particles is 4.7 weight %, causes no image-quality defect by irregularity in density.

Generally when the average sphericality of ethylene tetrafluoride resin particles is the same, increase in the content (weight %) of ethylene tetrafluoride resin particles leads to increase of the surface roughness (Ra) and also to decrease in the contact area between the photoreceptor and the electrostatically charging unit during storage.

In Example 6, in which the content of ethylene tetrafluoride resin particles is 3.8 weight %, the surface roughness (Ra) is significantly lower at 0.06 μm, while, in Example 1 in which the content of ethylene tetrafluoride resin particles is 4.7 weight %, the surface roughness (Ra) is much larger at 0.14 μm than that in Example 6. The results in Examples 1 and 6 on the image-quality defect caused by irregularity in density reflect the difference in surface roughness (Ra) and suggest that a content of ethylene tetrafluoride resin particles of about 4.5 weight % or more leads to increase in surface roughness (Ra), making the film resistant to image-quality defect caused by irregularity in density.

Similarly when Examples 4 and 5, in which the average sphericality is the same at 0.68 but the content of ethylene tetrafluoride resin particles is different, are compared, there is linear image defect observed in the formed image in Example 5, in which the content of ethylene tetrafluoride resin particles is 9.0 weight %, while there is no linear image defect observed in Example 1 in which the content of ethylene tetrafluoride resin particles is 7.3 weight %.

Generally, an excessively larger content of ethylene tetrafluoride resin particles leads to increase of the surface roughness (Ra), increased linear scratching on the surface of the charge-transporting layer 613 caused by separation of aggregates of fluorine resin particles after repeated image forming, and linear image defects in the formed image.

In Example 5 in which the content of ethylene tetrafluoride resin particles is 9.0 weight %, the surface roughness (Ra) is significantly larger at 0.75 μm, while, in Example 4 in which the content of ethylene tetrafluoride resin particles is 7.3 weight %, the surface roughness (Ra) is significantly smaller at 0.14 μm than that in Example 5. The results of Examples 4 and 5 on the linear image defect reflect the difference in surface roughness (Ra) and thus, indicate that a content of ethylene tetrafluoride resin particles of about 7.5% or less leads to favorable increase in surface roughness (Ra) and gives a film resistant to linear image defect.

It is obvious that there is less linear image defect when the content (weight %) of the ethylene tetrafluoride resin particles is in the range above, because, when Comparative Example 1 in which the content (weight %) of ethylene tetrafluoride resin particles is 4.7% and Comparative Example 3 in which the content (weight %) of ethylene tetrafluoride resin particles is 9.0% are compared, there is linear image defect observed in Comparative Example 3, while there is no linear image defect in Comparative Example 1.

In summarizing the findings above, an average sphericality of ethylene tetrafluoride resin particles contained in the charge-transporting layer of 0.7 or less is preferable in preventing the image-quality defect by irregularity in density. In addition, a content of ethylene tetrafluoride resin particles in the range of 4.5 weight % or more and 7.5 weight % or less is more effective in preventing the image-quality defect caused by irregularity in density and also the linear image defect.

Although a monochromic or color single-sided printing printer was used as an example in description above, the image-forming apparatus according to the invention may be applied to a double-face output printer. Alternatively, it may be applied to apparatuses other than a printer, such as a copying machine and a fax machine.

What is claimed is:

1. An image carrier comprising:

a conductive base material; and a photosensitive layer formed on the base material, wherein the photosensitive layer includes an undercoat layer formed on the base material, a charge-generating layer formed on the undercoat layer, and a charge-transporting layer which is formed on the charge-generating layer and which is an outermost surface layer, the charge-transporting layer contains aggregate particles of a fluorine resin in an amount of 4.5% or more and 7.5% or less by weight, each particle of the aggregate particles having a number-averaged particle sphericality represented by Formula (1) of 0.62 or more and 0.7 or less: sphericality$=4\pi A/L^2$ (1), where $\pi$ represents the circular constant, A represents a projection area of each particle of the aggregate particles, and L represents a peripheral length of a projected image of each particle of the aggregate particles, and the charge-transporting layer has a surface having a center-line average roughness (Ra) of 0.1 μm or more and 0.5 μm or less.

2. The image carrier according to claim 1, wherein the particles are particles of an ethylene tetrafluoride resin.

3. The image carrier according to claim 1, wherein the base material is formed of aluminum.

4. The image carrier according to claim 1, wherein the undercoat layer prevents light entering the image carrier from being reflected on a surface of the base material, the charge-generating layer generates a charged carrier by receiving the light, and the charge-transporting layer transports the charged carrier.

5. The image carrier according to claim 1, wherein the charge-generating layer is a layer containing phthalocyanine.

6. A process cartridge comprising:

an image carrier having a conductive base material and a photosensitive layer formed on the base material, wherein the photosensitive layer includes an undercoat layer formed on the base material, a charge-generating layer formed on the undercoat layer, and a charge-transporting layer which is formed on the charge-generating layer and which is an outermost surface layer;

the charge-transporting layer contains aggregate particles of a fluorine resin in an amount of 4.5% or more and 7.5% or less by weight, each particle of the aggregate particles having a number-averaged particle sphericality represented by Formula (1) of 0.62 or more and 0.7 or less: sphericality$=4\pi A/L^2$ (1), where it represents the circular constant, A represents a projection area of each particle of the aggregate particles, and L represents a peripheral length of a projected image of each particle of the aggregate particles;

the charge-transporting layer has a surface having a center-line average roughness (Ra) of 0.1 μm or more and 0.5 μm or less; and an electrostatically charging unit that charges the image carrier by contacting the image carrier.

7. An image-forming apparatus comprising:

an image carrier having a conductive base material and a photosensitive layer formed on the base material, wherein the photosensitive layer includes an undercoat layer formed on the base material, a charge-generating layer formed on the undercoat layer, and a charge-transporting layer which is formed on the charge-generating layer and which is an outermost surface layer;

the charge-transporting layer contains aggregate particles of a fluorine resin in an amount of 4.5% or more and 7.5% or less by weight, each particle of the aggregate particles having a number-averaged particle sphericality represented by Formula (1) of 0.62 or more and 0.7 or less: sphericality$=4\pi A/L^2$ (1), where $\pi$ represents the circular constant, A represents a projection area of each particle of the aggregate particles, and L represents a peripheral length of a projected image of each particle of the aggregate particles;

the charge-transporting layer has a surface having a center-line average roughness (Ra) of 0.1 μm or more and 0.5 μm or less;

an electrostatically charging unit that charges the image carrier by contacting the image carrier; and an image-forming unit that forms an electrostatic latent image on the image carrier charged by the electrostatically charging unit and thereby forms a developed image by developing the electrostatic latent image.

* * * * *